US006743095B2

(12) United States Patent
Cole et al.

(10) Patent No.: US 6,743,095 B2
(45) Date of Patent: Jun. 1, 2004

(54) INTELLIGENT METERING SYSTEM

(76) Inventors: Joseph W. Cole, 7221 Sandy Plains Ave., Las Vegas, NV (US) 89131; Michael J. Bennett, 3061 Sheridan St., Las Vegas, NV (US) 89102

( * ) Notice: Subject to any disclaimer, the term of this patent is extended or adjusted under 35 U.S.C. 154(b) by 216 days.

(21) Appl. No.: 09/872,132

(22) Filed: Jun. 1, 2001

(65) Prior Publication Data

US 2002/0189917 A1 Dec. 19, 2002

(51) Int. Cl.[7] ..... A63F 9/24
(52) U.S. Cl. ..... 463/25; 463/47
(58) Field of Search ..... 463/25, 30, 31, 463/39, 43, 47

(56) References Cited

U.S. PATENT DOCUMENTS 4,004,097 A 1/1977 Spaulding
4,352,104 A 9/1982 Mizuta et al.
5,257,179 A 10/1993 DeMar
5,580,310 A 12/1996 Orus et al.
2002/0109609 A1 * 8/2002 Potter et al. ..... 340/932.2

* cited by examiner

*Primary Examiner*—Kim Nguyen
(74) *Attorney, Agent, or Firm*—Weide & Miller, Ltd.

(57) ABSTRACT

The present invention is an intelligent metering system for currency-activated devices having an electromechanical meter. The intelligent metering system includes an inductive pickup winding associated with the electromechanical meter. An amplifier is coupled to the inductive pickup winding to boost a signal detected from the inductive pickup winding when electromechanical meter is actuated. A pulse detector, coupled to the amplifier, detects pulses, false triggerings and filters out EMF spikes. A microprocessor is coupled to the pulse detector for counting the pulses detected by the pulse detector and for storing meter data related to the counted pulses in a memory device. An interface is coupled to the microprocessor for transmitting the meter data from the memory device.

15 Claims, 3 Drawing Sheets

INTELLIGENT METERING SYSTEM

FIELD OF THE INVENTION

The present invention is directed to metering systems, and more particularly to a method and apparatus for reading electromechanical counters electronically, and/or remotely.

BACKGROUND OF THE INVENTION

The gaming, arcade, and vending machine industry relies heavily on electromechanical counters, otherwise referred to as meters, to count coin and currency input. These electromechanical counters are the default standard used by gaming compliance agencies and other business entities to keep track of the monetary history of these devices. The meters report coin-in, coin-out (coins paid out), coins to drop (coins that go to the drop bucket), the number of games played, the number of jackpots, etc. Vending machines and arcade game machines use meters for similar functions.

FIG. 1 illustrates an example of such a meter as used in a gaming machine for tracking "coins in". As illustrated, the meter 20 is associated with a meter interface 22. The interface 22 is normally associated with a master gaming machine controller 24. The meter 20 includes a visible count indicator 26 in the form of rotating wheels having numbers printed thereon, the wheels cooperating to present a value indicative of coin input or other data. A person may visually inspect the count indicator 26 to obtain the data.

In use, a signal may be transmitted from a coin comparitor 30 or hopper 32 indicating that a coin has been received. This signal may be transmitted to the master gaming machine controller 24. The master gaming machine controller 24 then sends a signal to the meter interface 22 indicating that a coin has been input, and that the meter 20 should be caused to increment the visible count indicator 26. The signal from the master gaming machine controller 24 to the meter interface 22 is generally in accordance with a unique, and often proprietary communication/data protocol. The importance of this will be understood below. In any event, once the interface receives the data, it sends a signal to the meter 20 causing the meter to mechanically rotate one of the wheels of the count indicator 26 to reflect the coin input.

In the gaming industry, electronic systems have been devised that tap into the wire leads of the electromechanical meters and use an optically-isolated circuit that receives current when the meter is energized. This is used to acquire what is commonly known as the "soft" count (as opposed to a "hard" count, which comprises viewing the visible count indicator to obtain the data), because the machine system software is used to store the updated meter information in the machine logic board, or in a computer database via a network from the machine.

The interface and installation of these systems are labor intensive and require skilled technicians to properly tap into the meters. Errors in the installation can cause the machine and the meter to malfunction. For example, by tapping into the meter leads, the impedance and other electrical characteristics of the circuit may be substantially altered. This alteration may prevent proper operation of the meter. Additionally, the amount of circuitry and cabling required to interface with all of the various types of machines and manufacturers is extensive.

Another problem is that the firmware program required to support all of the different installations and machine types is extensive and requires very specialized programming skills.

In the gaming industry, the more modem slot machine designs provide meter information via a specialized serial interface which, as discussed above, may operate in accordance with a proprietary protocol. Because slot machine vendors often sell electronic slot machine accounting systems, they will charge fees to use the protocol. Some of these protocols have become industry standards, and the owners of these standards charge fees for the latest versions or enhancements. Thus, obtaining the meter information by tapping into the data lines first requires knowledge of ever-changing protocols and complex programming, and may also require payment to the slot machine vendor which owns the rights in the proprietary protocol.

No matter how new the design of the machine is and the protocol for data transfer with its interface, however, the electromechanical meter is still the standard for measurement. Just like an odometer in an automobile, it must be reliable and trusted and not easily tampered with. The electromechanical meter manufacturers design these devices to work reliably for millions of cycles. The meters are placed in machines to function autonomously. They are mounted in the machine housing, and even if the logic board of a machine is changed (such as putting a new game into an old machine, using new hardware and/or software), the meters remain intact. In a gaming environment, a meter change in a slot machine, or any other gaming machine, must be reported to the appropriate gaming compliance agency.

Nevertheless, electromechanical counters are sill prone to tampering. Although these electromechanical counters do not have a reset feature, they still may be physically altered. Furthermore, a person reading the electromechanical counter may mistakenly misread and record the number shown on the meter, or an unscrupulous individual may deliberately record the wrong number. Therefore, inaccurate data of the financial performance of the machines would be reported. The ability to tamper with the counters to meters without detection has lead to abuse by unscrupulous collectors and service personnel who may decrease the number of games played (or coins inserted, etc.) in order to collect the unreported portion of the revenue.

SUMMARY OF THE INVENTION

The present invention comprises an intelligent metering system. In one embodiment, the invention comprises a secondary metering system associated with a primary metering system which includes an electromechanical meter.

In one embodiment, the intelligent metering system includes a detector for passively detecting an event of the electromechanical meter. In a preferred embodiment, such an event comprises the receipt of an electrical signal activating the electromechanical meter for incrementing or decrementing a visible count indicator of the meter. The detector provides an output to a controller. The controller manipulates the detector output, such as by counting output signal pulses and/or transmitting an output.

In one embodiment, the detector comprises an inductive pickup coil or winding. The controller includes an amplifier coupled to the inductive pickup winding to boost a signal detected from the inductive pickup winding, a pulse detector coupled to the amplifier for detecting pulses, a microprocessor coupled to the pulse detector for counting the pulses detected by the pulse detector and for storing meter data related to the counted pulses in a memory device, and an interface coupled to the microprocessor for transmitting the meter data from the memory device.

In one embodiment, the inductive pickup coil comprises a secondary winding on an actuator electromagnet of the electromechanical meter. In another embodiment, the inductive pickup coil is located in a housing positioned adjacent the electromechanical meter.

In one or more embodiments, the interface associated with the microprocessor comprises a wireless communication interface. The wireless interface may implement an infrared or wireless frequency communication protocol/architecture.

Further objects, features, and advantages of the present invention over the prior art will become apparent from the detailed description of the drawings which follows, when considered with the attached figures.

DETAILED DESCRIPTION OF THE INVENTION

The invention is an intelligent metering system. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Figure 1:
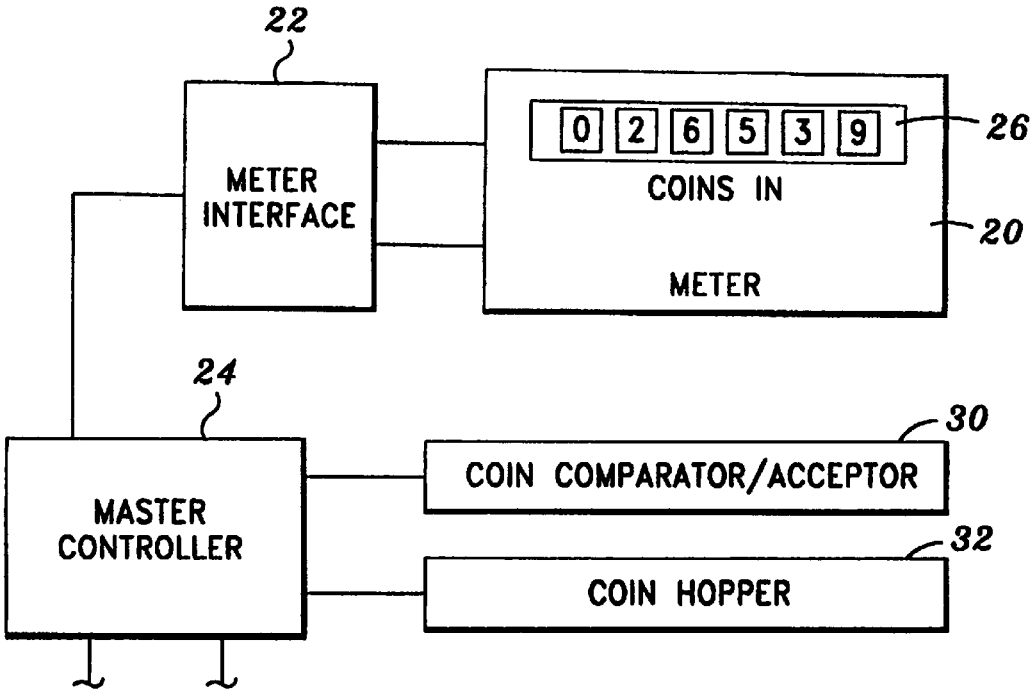
FIG. 1 (PRIOR ART)
FIG. 1 illustrates an electromechanical meter and associated control in accordance with the prior art.
Figure 2:
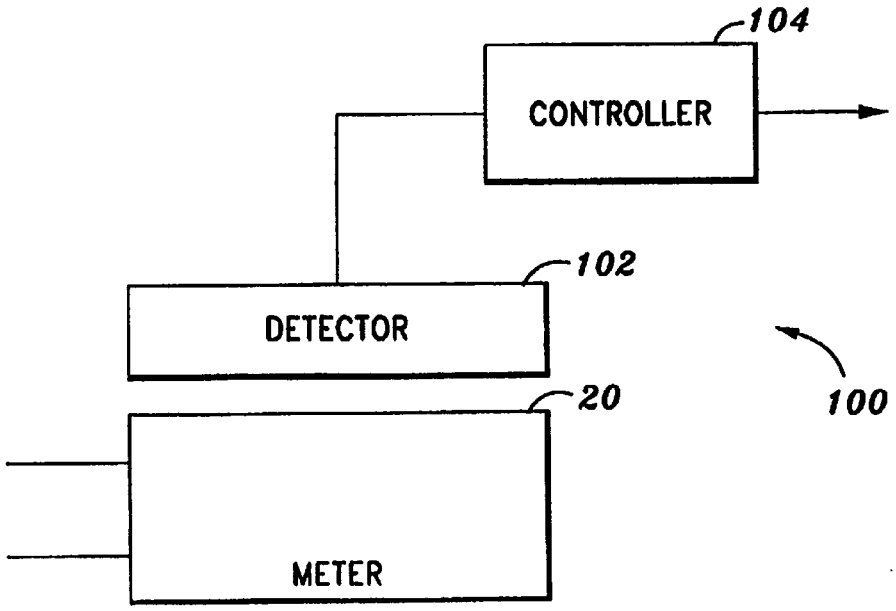
FIG. 2 is a schematic diagram of the intelligent metering system in accordance with the present invention.

FIG. 2 is a schematic diagram illustrating an intelligent metering system 100 in accordance with an embodiment of the present invention. As illustrated, the intelligent metering system 100 comprises a secondary metering system associated with a primary metering system. Preferably, the primary metering system comprises a metering system such as that illustrated in detail in FIG. 1, including an electromechanical meter 20. As detailed above, such a primary metering system may include a meter interface for generating an electrical signal which activates the electromechanical meter, causing the meter to actuate. In one embodiment, the actuation is of a visible indicator of the meter.

In accordance with the invention, the intelligent metering system includes a detector 102 and a controller 104. In general, the detector, 102 is arranged to detect a meter event. In one embodiment, the detector 102 is arranged to detect a signal associated with the incrementing/decrementing of the meter 20, and more particularly the visible count indicator thereof. In the preferred embodiment of the invention, the detector 102 comprises a "passive" detector, in that it is arranged to detect such an event/signal without needing to directly intercept the signal. In one embodiment, the detector 102 comprises a field sensor (such as described below in detail).

In another embodiment, the detector 102 may be arranged to detect a meter event by other than detection of the signal. For example, the detector 102 may comprise an optical sensor for detecting the movement of one or more of the wheels or other moving mechanical indicators of the meter 20. In another embodiment, the detector 102 may comprise a reader, such as a camera or other optical reader for reading the visible count indicator itself.

The detector 102 is arranged to provide an output signal to the controller 104. The controller 104 may comprise a wide variety of devices/components. Preferably, the controller 104 comprises a device which receives the detector 102 output signal and manipulates or transfers that signal. In one embodiment, the controller 104 may use the signal as an input to change a data value in a memory, the data value associated with the signal event (such as the counting of coins input). In another embodiment, the controller 104 may output the signal or other data to a remote device or devices, such as a remote accounting system where data is tracked and stored.

Figure 3:
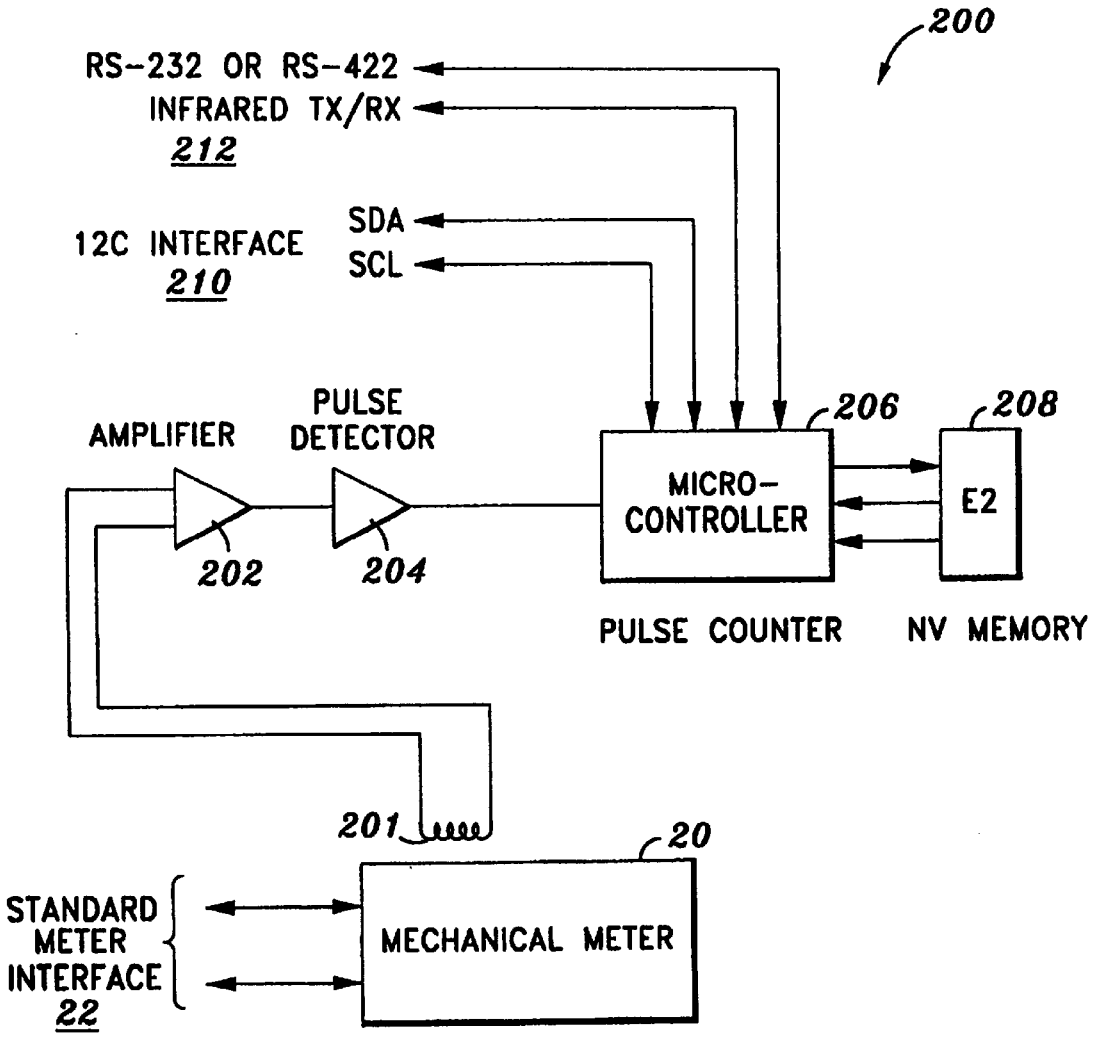
FIG. 3 is a schematic diagram of a particular implementation of an intelligent metering system according to an embodiment of the present invention.

FIG. 3 illustrates a preferred embodiment of a metering system 200 in accordance with the invention. In this embodiment, the detector comprises an inductive pickup winding or coil 201. In one embodiment, the pickup coil 201 may be located adjacent to the meter 20 for detecting a magnetic flux generated by an electrical signal/impulse. In this embodiment, the coil 201 may be positioned in a housing which is mounted adjacent to or directly to the meter 20. The construction of the coil 201, including the number of windings, may vary depending on the desired sensitivity, the distance of the coil 201 from the wires carrying the electrical signal in the meter 20, and the strength of the signal in the meter 20, among other factors. In this embodiment, it will be appreciated that the detector is a passive detector, in that only by activation of the meter 20 is the detector (i.e. coil 201) activated.

In another embodiment of the invention a standard electromechanical counter may be manufactured with a secondary winding on the actuator electromagnet of the electromechanical meter 20. This secondary winding is used as the inductive pickup winding/coil 201. The inductive pickup coil 201 is used in conjunction with the electronic circuits of the metering system to sense and count the counter actuations without affecting the normal operation or reliability of the electromechanical meter 20. In one embodiment, the inductive pickup winding 201 is preferably formed from 15–17 turns of an enamel-coated 34-gauge solid copper wire.

In this embodiment, the controller comprises an amplifier 202, a pulse detector 204, a pulse counter 206, and a memory 208: The amplifier 202 boosts a signal from the inductive pickup winding 201 when the actuator electromagnet is actuated so that the signal has enough amplitude to trigger the pulse detector 204. For example, when currency is placed into a slot machine, the slot machine determines the value of the currency deposited, and then transmits an actuation signal to the actuator electromagnet of the electromechanical meter 20 to actuate the meter 20 a specific number of times depending on the value of the currency and the value of the units to be registered by the meter 20. For example,.if a dollar is inserted into the slot machine and the electromechanical meter 20 stores the units in increments of 25 cents, then the actuator electromagnet will receive four actuation signals to add four "turns" to the electromechanical meter 20. When the electrical signal is sent to the actuator electromagnet to turn the electromechanical meter 20, the inductive pickup coil 201, along with the electronic circuits of the metering system, passively detects, counts and records each of the signals made to the actuator electromagnet.

The pulse detector 204 preferably comprises a comparator circuit with hysteresis so as to illuminate false triggering and to filter out EMP spikes, along with its primary purpose of detecting pulses. In one or more embodiments of the invention, the pulse detector 204 may simply comprise a low-pass filter.

The microprocessor 206 is used to count the pulses as the electromechanical meter 20 is actuated. The microprocessor 206 may be of a variety of types. In one embodiment, the microprocessor 206 comprises an 8-bit microcontroller such as a Phillips Semiconductor Model 87C751 microprocessor.

In one embodiment, the microprocessor 206 is also adapted to store pulse/count meter data in a memory device 208. In a preferred embodiment, the memory device 208 comprises a non-volatile memory device such as an Amtel 93C46 electrically-erasable programmable read-only (EEPROM) memory chip. The memory device 208 may be of a variety of other types, including RAM, DRAM, SDRAM and the like.

In one embodiment, the intelligent metering system 200 includes means for transmitting meter data to a remote device. Preferably, this means comprises a communication interface associated with the microprocessor 206 for outputting data therefrom.

In one embodiment, first and second interfaces 210 and 212 may be coupled to the microprocessor 206 to transmit the meter data to an external device. For example, the microprocessor 206 may utilize an industry standard I2C 3-wire interface 210, or a standard EIA RS-232 or RS-422 interface 212, or both, for connecting to a networked electronic accounting system, or to an external receiving device. Optionally, a wireless transceiver interface (not shown) may also be used to download the meter data to a palm-top computer device, a laptop computer, or other similar receiving device equipped with a port capable of interfacing with the transceiver. The wireless interface may be adapted to implement an infrared or radio frequency communication architecture/protocol, such as Bluetooth™ or IEEE 802.11 (b).

The intelligent metering system according to an embodiment of the present invention may be especially useful for acquiring slot machine, vending machine, or arcade machine hard count meter data (electromechanical readings) remotely via radio frequency, or via a land-based media, such as over a telephone line or a paging system.

In addition to currency-driven machines, such as slot or other gaming machines, vending machines, or arcade machines, the intelligent metering system may be utilized in any device having an electromechanical meter or counter, such as in a printing or photocopier machine. Therefore, service personnel do not need to open up the machine and read the electromechanical meter, but may only need to simply connect a portable receiving device, such as a hand-held computer, into the interface of the printing or photocopier machine to read and record the meter data.

The intelligent metering system according to an embodiment of the present invention does not require any other special interface in order to detect the actuation of the electromechanical meter. In addition, no special protocols are required, as industry standard interfaces are used to transmit data from the metering system.

Therefore, in utilizing the intelligent metering system of the present invention, an accurate "hard" count reading may be obtained, and the values may also be compared with the electromechanical meter in order to verify accuracy, as well as determining whether the electromechanical meter itself has been tampered. Furthermore, the values obtained from the intelligent metering system are as reliable as the "hard" count reading because the intelligent metering system is entirely passive and dependent upon the actuation of the actuator electromagnet of the electromechanical meter 20. That is, it "counts" a pulse only when the electromechanical meter 20 is actuated and requires no active input (such as electrical leads carrying a live current). Therefore, the intelligent metering system does not have live wires connected to it in order to receive direct signals each time the actuator electromagnet of the electromechanical meter 20 receives a signal.

The intelligent metering system is preferably self-contained and entirely separate from the logic/circuit board of the machine in which it is placed. The self-contained intelligent metering system is such that any tampering with the logic/circuit board of the machine will not affect the intelligent metering system. And, to be as tamper resistant as possible, the intelligent metering system should not be dependent upon external power sources; that is, the microprocessor 206 and the memory 208 should be self-powered and maintenance free. The intelligent metering system should be functional in the event of a power failure, or even when no power at all is provided to the machine it which it is placed. Furthermore, the memory 208 should be unable to receive inputs from any other source except from the microprocessor 206 of the intelligent metering system. In addition, the intelligent metering system should be secure enough so that tampering of any of its components, especially the microprocessor 206 and the memory 208, is not possible, or that the intelligent metering system is capable of recognizing when tampering has occurred and recording such information. Therefore, the intelligent metering system, working in conjunction with the electromechanical meter 20, is capable of providing accurate and reliable "hard" count meter data, and accurate transmission of the meter data may be performed via the interface. The intelligent metering system also provides a reliable and accurate system for storing meter data that is more tamper resistant than electromechanical meters or counters.

An advantage of the intelligent metering system of the invention is that it can be associated with an existing primary metering system already in use in a device. Thus, the intelligent metering system can easily be adapted in "retrofit" fashion to an existing device. In one embodiment, the retrofit comprises the installation of the detector (such as winding 201) near the meter 20, along with the controller. In an embodiment where the detector comprises a secondary winding on the actuator electromagnet of the electromechanical meter 20, then the actuator electromagnet of the meter 20 or the entire meter 20 may be replaced.

Figure 4:
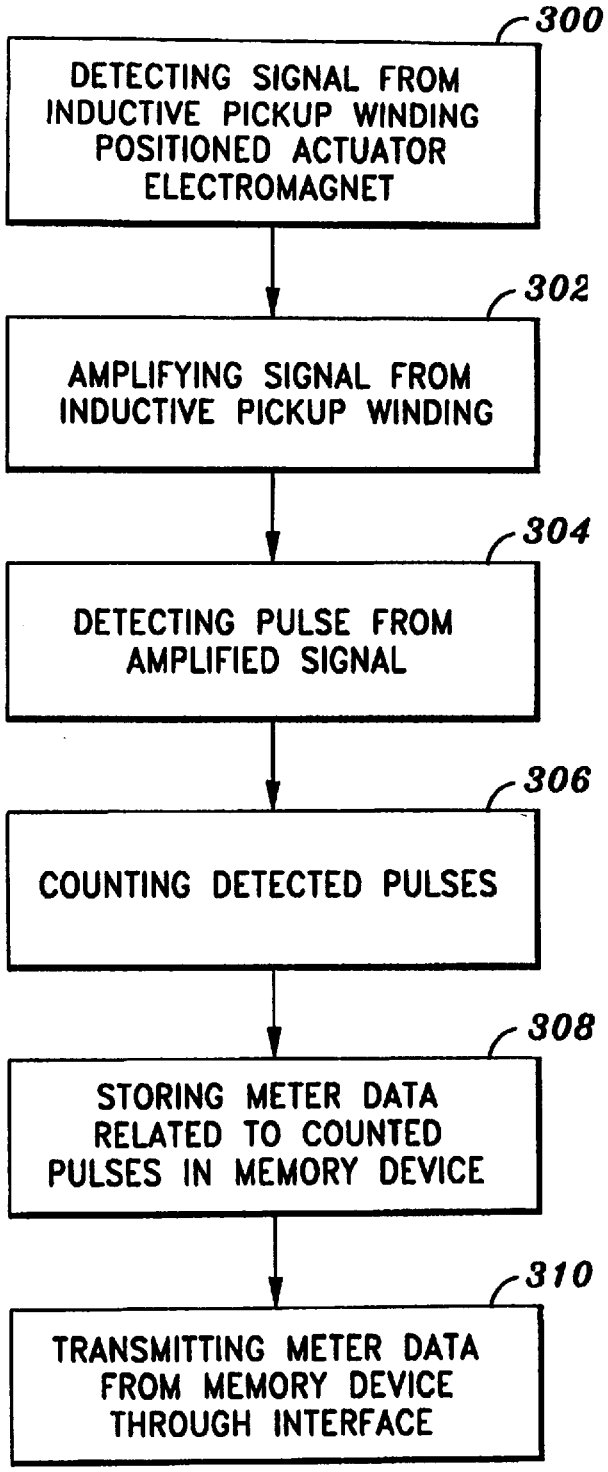
FIG. 4 is a block diagram of the steps of a method of reading an electromechanical meter according to an embodiment of the present invention.

FIG. 4 illustrates a block diagram of the steps of reading an electromechanical meter according to an embodiment of the present invention. Using the intelligent metering system according to an embodiment of the present invention described above, step 300 shows that a signal is first detected from the inductive pickup winding 201 positioned on the actuator electromagnet of the electromechanical meter 20 when the actuator electromagnet is actuated. In step 302, the detected signal from the inductive pickup winding 201 is amplified. Then in step 304, a pulse is detected from each amplified signal. The pulse is preferably detected by the pulse detector 204 that comprises a comparator circuit having hysteresis for detecting the pulses, detecting false triggerings, and filtering EMP spikes. In step 306, each of the detected pulses are counted, preferably by the microprocessor device 206. The microprocessor 206 preferably has a ROM or firmware storing microcode instructions for execution by the microprocessor 206 to count the detected pulses and store them as meter data. Meter data related to the counted pulses are then preferably stored by the microprocessor 206 in the memory device 208, such as a nonvolatile memory device, as in step 308. In step 310, the meter data may be transmitted from the memory device 208 through the interface 210 and 212. The interface 210 and 212 may be any standard type of interface, such as an 12C interface, or an RS-232 or RS-422 interface. As mentioned above, the meter data may be transmitted to any receiving device, such as a hand-held or laptop computer, adapted to interface with the intelligent metering system to receive the meter data.

The intelligent metering system may be adapted for use with a variety of primary metering systems. As detailed, the intelligent metering system is used with a primary metering system including an electromechanical meter for generating "coin in" count data. The system of the invention may be used with primary metering systems having electromechanical meters for generating a wide variety of other count data, such as coins out and the like.

In one or more embodiments, more than one-intelligent metering system may be provided when a gaming machine includes more than one electromechanical meter. In one embodiment, the intelligent metering system may include a single controller 104 and a plurality of detectors 102, the detectors 102 associated with a plurality of electromechanical meters. In such event, the single controller 104 may be adapted to use the output signals from the plurality of detectors 102 to generate a plurality of count data.

In one or more embodiments of the invention, the intelligent metering system may be used with electronic meters. Such meters may be provided an input signal which causes an electronic display of count data to be incremented. In this arrangement, the mechanical indicator (wheels, etc.) are replaced with an LCD, LED or other electrically powered or operated display.

While the description above refers to particular embodiments of the present invention, it will be understood that many modifications may be made without departing from the spirit thereof The accompanying claims are intended to cover such modifications as would fall within the true scope and spirit of the present invention.

We claim:

1. In a gaming machine, an intelligent metering system for a coin-counting electromechanical meter of said gaming machine which meter which is configured to increment in response to an input signal thereto, comprising:

an inductive pickup winding associated with said electromechanical meter, said pickup winding configured to detect said input signal to said electromechanical meter and create a signal in response thereto;

an amplifier coupled to the inductive pickup winding to boost said signal generated by the inductive pickup winding created in response to said detected input signal;

a pulse detector, coupled to the amplifier, for detecting pulses comprising said boosted signal;

a microprocessor coupled to the pulse detector for counting the pulses detected by the pulse detector and for storing meter data related to the counted pulses in a memory device; and an interface coupled to the microprocessor for transmitting the meter data from the memory device.

2. The intelligent metering system in accordance with claim 1 wherein said electromechanical meter includes an actuator electromagnet and said inductive pickup winding comprises a secondary winding of said actuator electromagnet.

3. The intelligent metering system according to claim 2, wherein the inductive pickup winding is formed with 15 to 17 turns of enamel-coated 34-gauge solid copper wire.

4. The intelligent metering system according to claim 1, wherein said inductive pickup winding is located in a housing adjacent said electromechanical meter.

5. The intelligent metering system according to claim 1, wherein the memory device comprises a re-writeable memory device.

6. The intelligent metering system according to claim 1, wherein the interface is a wireless communication interface.

7. The intelligent metering system according to claim 6, wherein the interface includes an infrared transceiver circuit for transmitting the meter data to a receiving device having an infrared port.

8. The intelligent metering system according to claim 1, wherein the pulse detector comprises a comparator circuit with hysteresis.

9. The intelligent metering system according to claim 1, including a meter interface adapted to send an electrical signal to said electromechanical meter for causing actuation of said meter.

10. A method of reading a coin-counting electromechanical meter of a gaming machine, the method comprising the steps of:

creating an output signal with an inductive pickup winding in response to an input signal provided to said electromechanical meter associated with a coin-counting increment of said electromechanical meter;

detecting said output signal from said inductive pickup winding;

amplifying the output signal from the inductive pickup winding;

detecting a pulse from the amplified signal;

counting the detected pulses;

storing meter data related to the counted pulses in a memory device; and transmitting the meter data from the memory device through an interface.

11. The method of reading an electromechanical meter according to claim 10, wherein the step of detecting the pulse from the amplified signal is performed by a pulse detector comprising a comparator circuit with hysteresis for detecting pulses, detecting false triggerings and filtering out EMP spikes.

12. The method of reading an electromechanical meter according to claim 10, wherein the step of counting the detected pulses is performed by a microprocessor.

13. The method of reading an electromechanical meter according to claim 10, wherein said transmitting step comprises transmitting said meter data via a wireless communication link.

14. In combination, an electromechanical coin-counting meter of a gaming machine, said meter including a mechanical count indicator, a meter interface adapted to generate an electrical signal for causing said electromechanical meter to actuate said mechanical count indicator, and a secondary metering system, said secondary metering system including at least one pickup coil associated with said electromechanical meter, said at least one pickup coil adapted to generate a pulse in response to the activation of said electromechanical meter, and a processor adapted to count pulses generated by said at least one pickup coil.

15. The combination in accordance with claim 14, including at least one coin accepting device associated with said meter interface, said at least one coin accepting device adapted to output a signal associated with the receipt of a coin, and wherein said meter interface is configured to generate said electrical signal in response to the input of said signal which is output from said coin accepting device.

* * * * *